US009226084B2

(12) United States Patent
Andersen et al.

(10) Patent No.: US 9,226,084 B2
(45) Date of Patent: Dec. 29, 2015

(54) METHOD OF OPERATING A HEARING AID AND A HEARING AID

(71) Applicant: WIDEX A/S, Lynge (DK)

(72) Inventors: Kristian Timm Andersen, Lyngby (DK); Morten Holm Jensen, Farum (DK)

(73) Assignee: WIDEX A/S, Lynge (DK)

( * ) Notice: Subject to any disclaimer, the term of this patent is extended or adjusted under 35 U.S.C. 154(b) by 0 days.

(21) Appl. No.: 14/278,449

(22) Filed: May 15, 2014

(65) Prior Publication Data

US 2014/0247956 A1 Sep. 4, 2014

Related U.S. Application Data

(63) Continuation-in-part of application No. PCT/EP2011/073750, filed on Dec. 22, 2011.

(51) Int. Cl.
*H04R 25/00* (2006.01)

(52) U.S. Cl.
CPC ..... *H04R 25/50* (2013.01); *H04R 25/70* (2013.01); *H04R 2225/41* (2013.01); *H04R 2225/43* (2013.01)

(58) Field of Classification Search
CPC .... H04R 25/50; H04R 25/502; H04R 25/505; H04R 25/70; H04R 2225/43; H04R 2225/009; G10L 21/00; G10L 21/02; G10L 21/0216; G10L 21/0264; G10L 21/0364; G10L 21/057; G10L 15/00; G10L 15/02; G10L 17/00; G10L 25/00; G10L 25/27; G10L 25/03; G10L 25/84; G10L 25/78; G10L 25/93; G10L 2025/937; G10L 19/00
USPC ..... 381/316, 312, 317, 321, 71.1, 94.1, 381/94.2, 94.3
See application file for complete search history.

(56) References Cited

U.S. PATENT DOCUMENTS

| | | | | |
|---|---|---|---|---|
| 5,687,241 | A | 11/1997 | Ludvigsen | |
| 5,729,658 | A | 3/1998 | Hou et al. | |
| 2003/0023429 | A1 | 1/2003 | Claesson et al. | |
| 2005/0141737 | A1* | 6/2005 | Hansen | 381/316 |
| 2011/0164855 | A1* | 7/2011 | Crockett et al. | 386/230 |

FOREIGN PATENT DOCUMENTS

| | | | |
|---|---|---|---|
| EP | 1522206 | B1 | 10/2007 |
| WO | 99/34642 | A1 | 7/1999 |
| WO | 2007/005569 | A1 | 3/2007 |
| WO | 2007/120453 | A1 | 10/2007 |

OTHER PUBLICATIONS

International Search Report with Written Opinion ISA for PCT/EP2011/073750 dated Sep. 6, 2012.

* cited by examiner

*Primary Examiner* — Ahmad F Matar
*Assistant Examiner* — Sabrina Diaz
(74) *Attorney, Agent, or Firm* — Sughrue Mion, PLLC

(57) ABSTRACT

A method of processing a signal in a hearing aid (50) comprising the steps of determining a gradient of a speech intelligibility measure using a closed form expression of the gradient and modifying the frequency dependent hearing aid gains in dependence on the calculated gradient. The invention also provides a hearing aid (50).

10 Claims, 3 Drawing Sheets

METHOD OF OPERATING A HEARING AID AND A HEARING AID

RELATED APPLICATIONS

The present application is a continuation-in-part of application No. PCT/EP2011/073750, filed on Dec. 22, 2011, with the European Patent Office and published as WO-A1-2013091703.

BACKGROUND OF THE INVENTION

1. Field of the Invention

The present invention relates to a method of operating a hearing aid. More specifically the invention relates to a method of operating a hearing aid wherein speech intelligibility is optimized. Further the present invention relates to a hearing aid. The invention, in particular, relates to a hearing aid adapted to provide improved speech intelligibility.

A modern hearing aid comprises one or more microphones, a signal processor and a loudspeaker.

Prior to use, the hearing aid must be fitted to the individual user. The fitting procedure basically comprises adapting a transfer function dependent on level and frequency to best compensate the user's hearing loss according to the particular circumstances such as the user's hearing impairment and the specific hearing aid selected. The selected settings of the parameters governing the transfer function are stored in the hearing aid. The settings can later be changed through a repetition of the fitting procedure, e.g. to account for a change in impairment. In case of multi-program hearing aids, the adaptation procedure may be carried out once for each program, selecting settings dedicated to take specific sound environments into account.

2. The Prior Art

According to the state of the art, hearing aids process sound in a number of frequency bands with facilities for specifying gain levels according to some predefined input/gain-curves in the respective bands.

The level-dependent transfer function is adapted for compressing the signal in order to control the dynamic range of the output of the hearing aid. The compression can be regarded as an automatic adjustment of the gain levels for the purpose of improving the listening comfort of the user of the hearing aid, and the compression may therefore be denoted Automatic Gain Control (AGC). The AGC also provides the gain values required for alleviating the hearing loss of the person using the hearing aid. Compression may be implemented in the way described in the international application WO-A1-9934642.

Advanced hearing aids may further comprise anti-feedback routines for continuously measuring input levels and output levels in respective frequency bands for the purpose of continuously controlling acoustic feedback instability through providing cancellation signals and through lowering of the gain settings in the respective bands when necessary.

However, in all these "predefined" gain adjustment methods, the gain levels are modified according to functions that have been predefined during the programming and fitting of the hearing aid to reflect requirements for generalized situations.

Recently it has been suggested to use models for the prediction of the intelligibility of speech after a transmission though a linear system. The most well-known of these models is the "articulation index", AI, the speech intelligibility index, SII, and the "speech transmission index", STI, but other indices exist.

Determinations of speech intelligibility have been used to assess the quality of speech signals in telephone lines, see e.g. H. Fletcher and R. H. Galt "The perception of speech and its relation to telephony," J. Acoust. Soc. Am. 22, 89-151 (1950).

The ANSI S3.5-1969 standard (revised 1997) provides methods for the calculation of the speech intelligibility index, SII. The SII makes it possible to predict the intelligible amount of the transmitted speech information, and thus, the speech intelligibility in a linear transmission system. The SII is a function of the system's transfer function and of the acoustic input, i.e. indirectly of the speech spectrum at the output of the system. Furthermore, it is possible to take both the effects of a masking noise and the effects of a hearing aid user's hearing loss into account in the SII.

The SII is always a number between 0 (speech is not intelligible at all) and 1 (speech is fully intelligible). The SII is, in fact, an objective measure of the system's ability to convey speech intelligibly, indicating the probability of the listener being able to understand what is being said.

An increase of gain in the hearing aid will always lead to an increase in the loudness of the amplified sound, which may in some cases lead to an unpleasantly high sound level, thus creating loudness discomfort for the hearing aid user.

The loudness at the output of the hearing aid may be calculated according to a loudness model, e.g. by the method described in an article by B. C. J. Moore and B. R. Glasberg "A revision of Zwicker's loudness model", Acta Acustica Vol. 82 (1996) 335-345, which proposes a model for calculation of loudness in normal-hearing and hearing-impaired subjects. The model is designed for steady state sounds, but an extension of the model allows calculations of loudness of shorter transient-like sounds too. Reference is made to ISO standard 226 (ISO 1987) concerning equal loudness contours.

EP-B1-1522206 discloses a hearing aid and a method of operating a hearing aid wherein speech intelligibility is improved based on frequency band gain adjustments based on real-time determinations of speech intelligibility and loudness, and which is suitable for implementation in a processor in a hearing aid.

This type of hearing aid and operation method requires the capability of increasing or decreasing the gain independently in the different bands depending on the current sound situation. For bands with high noise levels, e.g., it may be advantageous to decrease the gain, while an increase of gain can be advantageous in bands with low noise levels, in order to enhance the SII. However, such a simple strategy will not always be an optimal solution, as the SII also takes inter-band interactions, such as mutual masking, into account. A precise calculation of the SII is therefore necessary.

As it is not feasible to compute a general relationship between the SII and a given change in amplification gain analytically, some kind of numerical optimization routine is needed to determine this relationship in order to determine the particular amplification gain that gives the largest SII value. However, deriving an optimization routine that provides optimized speech intelligibility in real time using the limited processing resources in a hearing aid is in no way straightforward.

It is therefore a feature of the invention to provide a method of operating a hearing aid wherein improved real-time optimized speech intelligibility is provided using the limited processing resources in a hearing aid.

It is another feature of the invention to provide a method of operating a hearing aid wherein improved listening comfort is provided together with real-time optimized speech intelligibility in varying sound environments.

It is a further feature of the invention to provide a hearing aid comprising means for optimizing speech intelligibility in real-time.

SUMMARY OF THE INVENTION

The invention in a first aspect provides a hearing aid with an input transducer, a processor, and an acoustic output transducer, said processor comprising a band-split filter, estimating means adapted for estimating speech and noise, means for providing a first gain vector comprising a first set of gain values to be applied in a corresponding set of frequency bands in order to alleviate a hearing loss of a hearing aid user, and a speech enhancement unit adapted for improving a speech intelligibility measure, wherein said speech enhancement unit comprises means for providing a second gain vector comprising an initial set of second gain values to be applied in a corresponding set of frequency bands, means for calculating a gradient of a speech intelligibility measure as a function of said second gain vector using a closed form expression and for iteratively updating the set of second gain values to improve speech intelligibility, means for modifying said first gain vector by application of the set of second gain values; and means for processing the input signal in accordance with said modified first gain vector, hereby providing an output signal adapted for driving said output transducer.

This provides a hearing aid that provides improved speech intelligibility.

The invention in a second aspect provides a method of processing a signal in a hearing aid, the method comprising the steps of receiving an input signal from a microphone, splitting the input signal into a number of frequency bands, selecting a first gain vector comprising a set of first gain values to be applied in a corresponding set of frequency bands in order to alleviate a hearing loss of a hearing aid user, selecting a second gain vector comprising an initial set of second gain values to be applied in a corresponding set of frequency bands; determining a set of gradient elements of a speech intelligibility measure as a function of the second gain vector, using a closed form expression of the gradient as a function of the second gain vector; updating the set of second gain values by application of the set of gradient elements, in order to determine a new set of second gain values optimized for speech intelligibility; determining whether to conduct further iterations, and in the affirmative reverting to the step of determining a set of gradient elements, and in the negative proceeding to the next step; modifying the first gain vector by application of the set of second gain values; and processing the input signal in accordance with the modified first gain vector, hereby providing an output signal adapted for driving an output transducer.

In an embodiment, the speech intelligibility measure is derived from the speech intelligibility index, and the energy summation approximation is used for calculating the equivalent masking spectrum level.

In another embodiment, the step of deriving the closed form expression of the gradient as a function of the second gain vector using a power function approximation and subsequent curve-fitting.

In a further embodiment, the speech intelligibility measure is derived from the speech intelligibility index, and the power function approximation and subsequent curve-fitting is used for calculating the band audibility.

Still other features of the present invention will become apparent to those skilled in the art from the following description wherein embodiments of the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
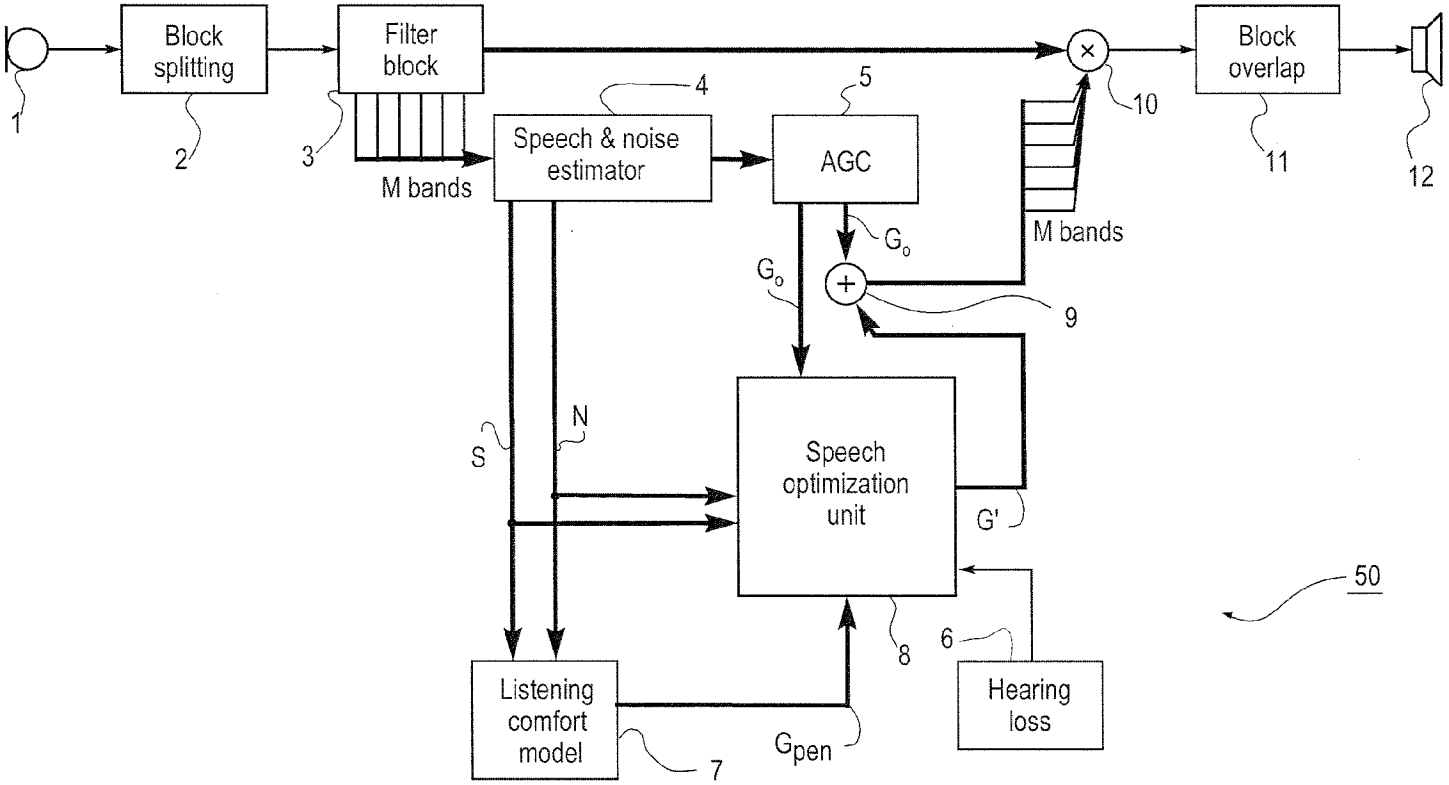
FIG. 1 illustrates highly schematically a hearing aid according to an embodiment of the invention.

Reference is first made to FIG. 1, which highly schematically illustrates a hearing aid 50 according to an embodiment of the invention.

The hearing aid 50 in FIG. 1 comprises a microphone 1 connected to a block splitting means 2, which further connects to a filter block 3. The block splitting means 2 may apply an ordinary, temporal, optionally weighted windowing function, and the filter block 3 may preferably comprise a predefined set of low pass, band pass and high pass filters defining the different frequency bands in the hearing aid 50.

The total output from the filter block 3 is fed to a multiplication point 10, and the output from the separate bands 1, 2, . . . M in filter block 3 are fed to respective inputs of a speech and noise estimator 4. The outputs from the separate filter bands are shown in FIG. 1 by a single, bolder, signal line. The speech level and noise level estimator may be implemented as a percentile estimator, e.g. of the kind presented in U.S. Pat. No. 5,687,241.

The output of multiplication point 10 is further connected to a loudspeaker 12 via a block overlap means 11. The speech and noise estimator 4 is connected to a speech optimization unit 8, to an Automatic Gain Control (AGC) means 5 and to a listening comfort model 7 by two multi-band signal paths carrying respectively the estimated signal S and the estimated noise N.

The block overlap means 11 may be implemented as a band interleaving function and a regeneration function for recreating an optimized signal suitable for reproduction. The block overlap means 11 forms the final, speech-optimized signal block and presents this to the loudspeaker 12.

The listening comfort model 7 uses the estimated signal S and the estimated noise N signal parts to determine, in each frequency band, a penalty gain value $G_{pen,f}$ that is used in the speech optimization algorithm in order to improve listening comfort. The multi-band output, i.e. a penalty gain vector $G_{pen}$, of the listening comfort model 7, is fed to the speech optimization unit 8. The listening comfort model is described in greater detail with reference to FIG. 3.

The AGC means 5 is connected to one input of a summation point 9, feeding it with a first set of gain values, $G_{0,f}$, for each frequency band, based on the compressor characteristics and the specific hearing loss of the hearing aid user. In variations of the embodiment of FIG. 1 said first set of gain values $G_{0,f}$ simply defines the hearing aid transfer function, excluding any noise reduction and/or speech enhancement features.

The AGC means 5 is preferably implemented as a multi-band compressor, for instance of the kind described in WO-A1-2007/025569.

The hearing loss model means 6 may advantageously be a representation of the hearing loss compensation profile already stored in the working hearing aid 50.

The speech optimization unit 8 comprises means for calculating a new set of optimized gain values $G'_f$, for each frequency band, comprised in the gain vector G', that are to be added to the gain vector $G_0$ comprising the gain values $G_{0,f}$ provided by the AGC. The output of the speech optimization unit 8, G', is fed to one of the inputs of summation point 9. The output of the summation point 9 is fed to the input of multiplication point 10.

The summation point 9, listening comfort model means 7, hearing loss model means 6 and speech optimization unit 8 form the optimizing part of the hearing aid according to an embodiment of the invention. In the hearing aid 50 in FIG. 1, speech signals and noise signals are picked up by the microphone 1 and split by the block splitting means 2 into a number of temporal blocks or frames. Each of the temporal blocks or frames, which may preferably be approximately 50 ms in length, is processed individually. Thus each block is divided by the filter block 3 into a number of separate frequency bands.

The frequency-divided signal blocks are then split into two separate signal paths where one goes to the speech and noise estimator 4 and the other goes to the multiplication point 10. The speech and noise estimator 4 generates two separate vectors, i.e. N, 'assumed noise', and S, 'assumed speech'. These vectors are used by the listening comfort model means 7 and the speech optimization unit 8 to distinguish between the estimated noise level and the estimated speech level.

The speech and noise estimator 4 may be implemented as a percentile estimator. A percentile is, by definition, the value for which the cumulative distribution is equal to or below that percentile. The output values from the percentile estimator each correspond to an estimate of a level value below which the signal level lies within a certain percentage of the time during which the signal level is estimated. The vectors preferably correspond to a 10% percentile (the noise, N) and a 90% percentile (the speech, S) respectively, but other percentile figures can be used. In practice, this means that the noise level vector N comprises the signal levels below which the frequency band signal levels lie during 10% of the time, and the speech level vector S is the signal level below which the frequency band signal levels lie during 90% of the time. The speech and noise estimator 4 implements a very efficient way of estimating for each block the frequency band levels of noise as well as the frequency band levels of speech.

The speech and noise estimator 4 also provides input to the AGC means 5 wherefrom the required gains $G_{0,f}$ for alleviating the hearing loss of the hearing aid user, in the various frequency bands, are determined.

The gain values $G_{0,f}$ from the AGC 5 are then summed with the optimized gain values $G'_f$ in the summation point 9 and provided to the multiplication point 10. Furthermore the gain values $G_{0,f}$ are fed to the speech optimization unit 8 in order to calculate the speech intelligibility value.

The listening comfort model means 7 contains an algorithm for determining a penalty gain value $G_{pen}$ that is used to find gain values G' that are optimized with respect to both listening comfort and speech intelligibility. The algorithm is further described below with reference to FIG. 3.

After optimizing the speech intelligibility, preferably by means of an iterative algorithm shown below with reference to FIG. 2, the speech optimization unit 8 presents the optimized gain values G' to an input of the summation point 9. The summation point 9 adds the vector comprising the optimized gain values G' to the input vector comprising the gain values $G_{0,f}$ from the AGC 5, thus forming a new, modified gain vector for the input of the multiplication point 10. Multiplication point 10 multiplies the appropriate gains from the modified gain vector to the signal from the filter block 3 and presents the resulting gain adjusted signal to the input of block overlap means 11. Hereby the hearing aid is provided with the desired transfer function.

In variations of the embodiment of FIG. 1 the speech optimization unit 8 directly provides the gain values to be applied to the signal from the filter block 3, whereby the summation point 9 can be omitted.

The online SII noise reduction algorithm attempts to maximize the Speech Intelligibility Index (SII) as defined by the American National Standards Institute, along with a modification for people with a hearing loss. The output of the algorithm is 15 gain values corresponding to the bands in the filterbank, that should be added to the compressor gain. Given a hearing threshold and a noise- and speech-estimate, the method attempts to adjust the 15 gain values so that the SII is maximized. The goal of the SII noise reduction is to find the maximum in the 15-dimensional gain space.

In variations the SII noise reduction algorithm can obviously be used with any multitude of frequency bands.

In other variations other models than SII can be used for the prediction of speech intelligibility such as e.g. the "Articulation Index" (AI), the "Speech Transmission Index" (STI) or the improved version of the SII described in the article: "Maximizing effective audibility in hearing aid fitting", by Ching, Dillon et al., in "Ear & Hearing, Vol. 22, No. 3, June 2001.

Thus in the following, the term "speech intelligibility measure" may be derived from any suitable model for the prediction of speech intelligibility. In general the SII-measure is non-linear, and a closed-form solution to the global maximum is not possible. Instead a gradient ascent method can be used. The algorithm works by iteratively taking steps in the direction of the gradient. By limiting the number of iterations and fixing the step size as a series of non-increasing lengths, it is assured that the algorithm stops after a predefined number of samples and that the final gain is close to a local maximum SII value within the allowed gain range.

Figure 2:
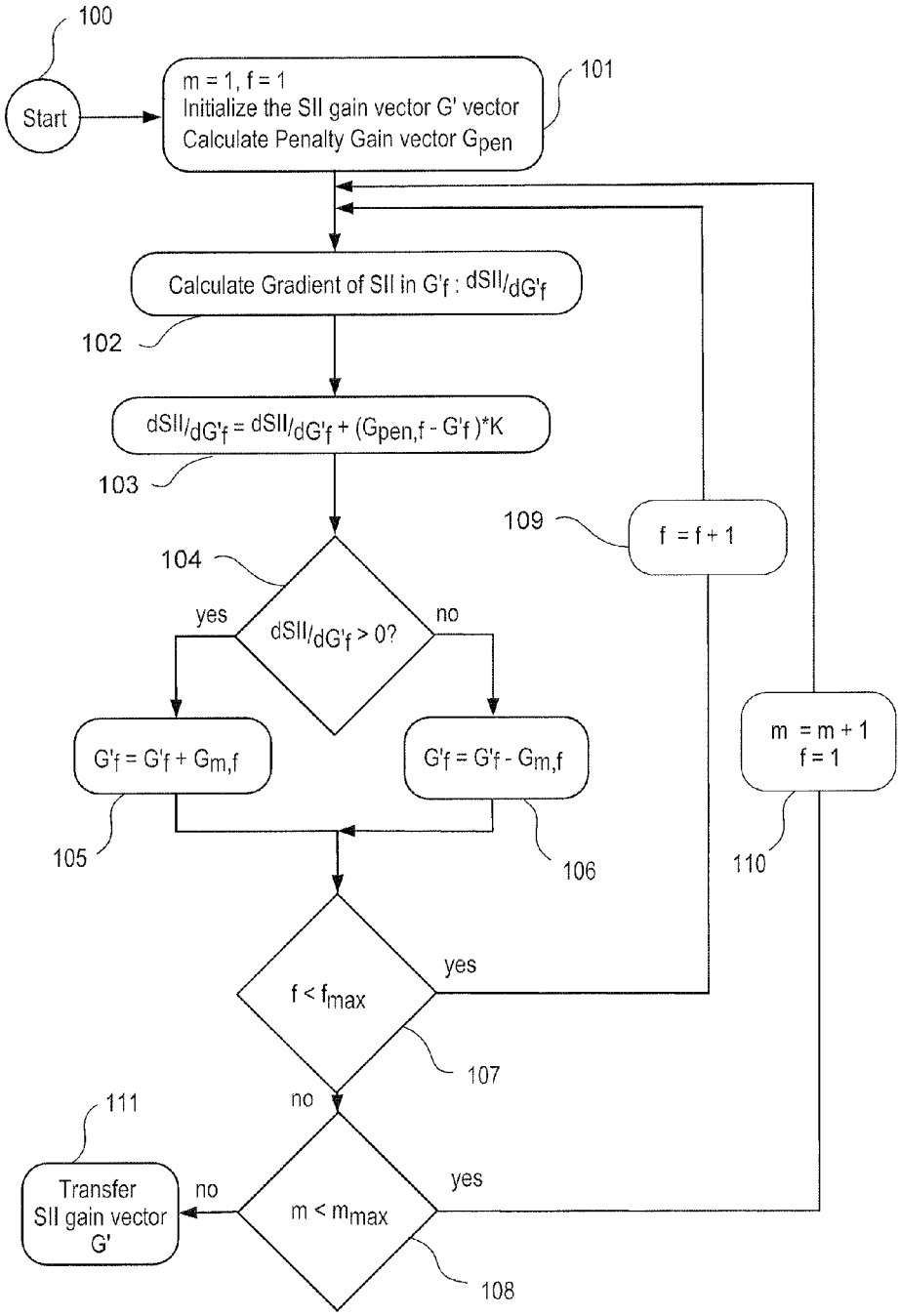
FIG. 2 is a simplified flow chart of a speech optimization algorithm according to an embodiment of the invention.

Reference is now given to FIG. 2, which is a flow chart of a speech optimization algorithm according to an embodiment of the invention.

The flow chart comprises a start point block 100 connected to a subsequent block 101, where an initial frequency band number f=1, an initial iteration number m=1, an initial SII gain vector G' and an initial penalty gain vector $G_{pen}$ are set. The elements of the gain vectors $G'_f$ and $G_{pen,f}$ represent the gain values corresponding to each of the frequency bands f of the hearing aid. The penalty gain values $G_{pen,f}$ are calculated in accordance with the algorithm described below with reference to FIG. 3.

The estimated speech vector S, the estimated noise vector N and the gain values $G_{0,f}$, which are required for the calculation of the gradient of the speech intelligibility measure and the penalty gain vector $G_{pen}$, are initialized once and kept constant throughout the optimization of the SII gain vector G'.

In the following step 102, the gradient of the speech intelligibility measure in the point $G'_f$ is determined. In the following the gradient in the point $G'_f$ may also be denoted a gradient element or a partial derivative of the gradient.

After step 102, the gradient of the speech intelligibility measure is modified in step 103 by adding a term comprising the difference between the penalty gain value $G_{pen,f}$ and the gain value $G'_f$, multiplied by a proportionality constant K.

In step 104 the sign of the modified gradient is determined. If the new modified gradient is positive, the algorithm continues in step 105, where a new gain value $G'_f$ is set to the current gain value $G'_f$ plus a gain value increment $G_{m,f}$. Otherwise, the routine continues in step 106, where the new gain value $G'_f$ is set to the current gain value $G'_f$ minus the gain value increment $G_{m,f}$. The gain value increment $G_{m,f}$ may be a constant or it may vary as a function of both iteration number m and/or frequency band number f.

The algorithm then continues in step 107 by examining the frequency band number f to see if the highest number of frequency bands $f_{max}$ has been reached. If this is not the case the frequency band number f is updated by one in step 109 and the algorithm proceeds to step 102.

According to a variation of the current embodiment the gain value increment $G_m$ depends on the iteration number m such that the magnitude of the gain value increment decreases with increasing iteration number.

When the highest number of frequency bands $f_{max}$ has been reached, the algorithm continues in step 108 by examining the iteration number m to see if the highest iteration number of $m_{max}$ has been reached. If this is not the case the iteration number m is updated by one, the frequency band number f is reset to one in step 110 and the algorithm proceeds to step 102.

The inventor has found that when the highest number of iterations $m_{max}$ has been reached, the need for further optimization no longer exists, and the resulting, speech-optimized gain value vector G' is transferred to the transfer function of the signal processor in step 111 and the optimization routine is terminated.

In essence, the algorithm traverses the $f_{max}$-dimensional vector space of $f_{max}$ frequency band gain values iteratively, optimizing the gain values $G'_f$ for each frequency band with respect to both speech intelligibility and listening comfort.

It should be appreciated that the inventor has found that the multi-dimensional optimization surface of the speech intelligibility generally comprises a relatively flat plateau where the speech intelligibility value is close to its global maximum. Within this region of the optimization space it is advantageous to improve the listening comfort since this can be done without significantly compromising the achieved speech intelligibility. Since this region is relatively flat, the gradient of the speech intelligibility value will be correspondingly low and the generally relatively limited magnitude of the term comprising the penalty gain $G_{pen}$ will therefore in this region be sufficient to direct the gradient towards a region with improved listening comfort without significantly compromising the speech intelligibility. The magnitude of the term comprising the penalty gain $G_{pen,f}$ is generally negligible compared to the magnitude of the gradient of the speech intelligibility measure when the speech intelligibility is far from its global maximum. Hereby the algorithm yields fast convergence towards optimized speech intelligibility.

It should further be appreciated that the inventor has found a method whereby the gradient of an SII index can be calculated in a manner so efficient that the calculation can be carried out in real-time in a hearing aid. This is achieved through a careful selection of approximations that have been proven to provide sufficiently precise results such that the calculated gradients with respect to the gain in each of the hearing aid bands can be used to optimize the SII index. According to the American National Standards Institute (ANSI), "Methods for calculation of the speech intelligibility index", ANSI S3.5-1997 the speech intelligibility index (SII) is calculated as a sum of contributions from the individual frequency bands:

$$SII = \sum_j SII(j) = \sum_j I(j) \cdot A(j)$$

I(j) is denoted the band importance function and A(j) is denoted the band audibility function. Further details concerning these functions can be found in ANSI S3.5-1997.

According to an article "Maximizing effective audibility in hearing aid fitting", by Ching, Dillon et al., in "Ear & Hearing, Vol. 22, No. 3, June 2001 the speech intelligibility index can be calculated in a slightly modified way (see equation (2) in the article):

$$SII = \sum_j I(j) \cdot L(j) \cdot K(j)$$

L(j) is denoted the level distortion factor and K(j) is denoted the desensitized audibility and is defined by (see equation (4) in the article):

$$K(j) = \frac{m_j}{\left(1 + \left(\frac{30}{SL(j)}\right)^{p_j}\right)^{1/p_j}}$$

The two parameters $m_j$ and $p_j$ depend on the $j^{th}$ frequency band and the hearing loss and are defined in the above mentioned article in the equations (5) and (6) respectively and using a set of v parameters, whose values are given in Table 1 in the article, and wherein v-parameters corresponding to the center frequencies of the hearing aid frequency bands are found using linear interpolation.

The function SL(j) represents the difference between the maximum level of the signal and the hearing threshold level in the $j^{th}$ frequency band. The closed form expression for SL(j) is derived by considering that K(j), according to the article, is equal to the temporary variable $K_t$, given in equation (12) in the ANSI standard, when $m_j$ equals 1 and $p_j$ is large:

$$SL(j)=E(j)+15-\mathrm{DIS}(j),$$

wherein E(j) is the equivalent speech spectrum level and DIS(j) is the equivalent disturbance spectrum level that is given by:

$$\mathrm{DIS}(j)=\mathrm{MAX}(Z(j),X(j)),$$

wherein Z(j) represents the equivalent masking spectrum level and X(j) the equivalent internal noise spectrum level. Further details concerning E(j), DIS(j), Z(j) and X(j) can be found in ANSI S3.5-1997.

The calculation of the gradient of the equivalent masking spectrum level Z(j) with respect to a hearing aid gain vector results in a very complex expression that requires too much processor power to be carried out in real-time in a hearing aid. It has been found that by using an energy summation approximation the calculation becomes feasible in a hearing aid while at the same time providing a sufficiently high precision of the calculation.

The inventor has further found that K(j) can effectively be approximated by a power function:

$$K(j)_{approx}=C_{2j}\cdot(1-2^{-C_{2j+1}\cdot SL(j)})$$

and the partial derivative of K(j) relative to the hearing aid gain G(j) can thus be expressed, through further approximations, as:

$$\frac{\partial K(j)}{\partial G(j)} = p_{diff}(j) \cdot \frac{\partial SL(j)}{\partial G(j)},$$

where $p_{diff}(j)$ is given as:

$$p_{diff}(j) = C_{2j} \cdot C_{2j+1} \cdot \ln(2) \cdot (x_j + 1 - \lfloor x_j \rfloor) \cdot 2^{\lfloor x_j \rfloor},$$

wherein the parameter $C_j$ is derived from the parameters $m_j$ and $p_j$ and determined using a curve fit and the parameter $x_j$ is given by:

$$x_j = -C_{2j+1} \cdot SL(j)$$

Ultimately the partial derivative of the SII with respect to the hearing aid gain G(i) in the $i^{th}$ frequency band can be approximated according to the equation given below:

$$\frac{\partial SII}{\partial G(i)} = -0.00625 \cdot I(i) \cdot K(i) + I(i) \cdot p_{diff}(i) \cdot (1 - 10^{(N(i)-Z(i))/10}) \cdot L(i) - \sum_{j \neq i} I(j) \cdot p_{diff}(j) \cdot 10^{\frac{(B(i)+C(i)-3.32 \cdot Log(F_j/h_i)-Z(j))}{10}} \cdot \left(1 + 3.32 \cdot \mathrm{Log}\left(\frac{F_j}{h_i}\right) \cdot 0.6\right) \cdot L(j)$$

The variables B(i) and C(i) are defined in ANSI S3.5-1997 in section 4.3.2.2 and 4.3.2.3 respectively. N(i) is the equivalent noise spectrum level, $F_j$ is the center frequency for the $j^{th}$ frequency band and $h_i$ is the higher frequency band limit for the $i^{th}$ frequency band. Further details concerning these latter variables can likewise be found in ANSI S3.5-1997.

In variations of the method for calculating the gradient (and thus the partial derivative) of an SII measure as a function of a hearing aid gain the expression for the gradient can be derived from any SII measure, i.e. using solely the expressions given in the ANSI standard instead of incorporating the expressions used in the article by Ching.

In variations of the embodiment according to FIG. 2, the method of optimizing a gain vector using only the gradient of a speech intelligibility measure can generally be combined with any method for ensuring an appropriate listening comfort, e.g. a method based on a traditional loudness model.

While the traditional loudness model is generally advantageous for ensuring listening comfort, some hearing aid users may have strong individual preferences with respect to what is considered good listening comfort, and in some cases a traditional loudness model will therefore not be the optimum solution.

According to the embodiment of FIG. 2 the value of the proportionality constant K is set to 0.5 and the increment gain value $G_{m,f}$ is set to 1 dB for m=1 and then decreases gradually down to 0.25 dB for $m=m_{max}$. In variations of the embodiment of FIG. 2 the increment gain values $G_{m,f}$ also depend on the frequency band f.

As the algorithm progresses, and takes a step in the direction of the gradient, it can only end up with a worse SII if it overshoots the maximum by taking a too long step or if the step crosses a discontinuity. If the step sizes are chosen as a non-increasing series with 1 dB or less difference between successive steps and the last steps only are 0.25 dB, the overshoot problem is negligible. A discontinuity is a problem for most optimization methods, but the inventor has found that the SII optimization surface is continuous and therefore does not contain any discontinuities that must be taken into consideration.

In a variation of the embodiment of FIG. 2 the value assigned to the proportionality constant K depends on the hearing aid program currently active in the hearing aid. In this way the value of K can be relatively large in listening situations (and corresponding hearing aid programs) where speech intelligibility is critical and relatively small in situations where listening comfort is of primary concern. In a further variation of the embodiment of FIG. 2, the value assigned to the proportionality constant K is controlled by a sound environment classifier, whereby an automatic and more smooth variation of the proportionality constant K can be achieved. In yet other variations the values assigned to the proportionality constant K are subjected to individual preferences of the hearing aid user.

It has been found that the present algorithm converges so fast that the initialization of the SII gain vector G' can be carried out simply by setting all the vector elements $G'_f$ to zero. This has the further advantage that one can always be certain that the speech optimization unit 8 provides a speech intelligibility value that is improved compared to the situation where the speech optimization is not enabled.

Figure 3:
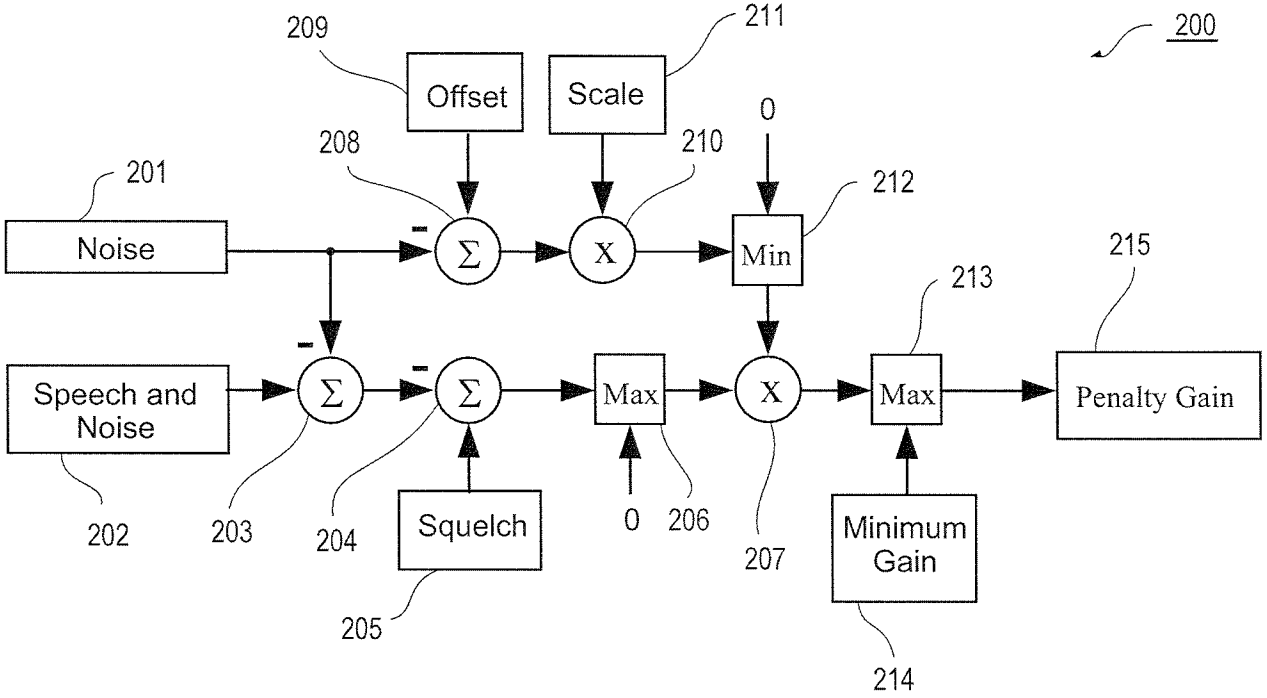
FIG. 3 is a block schematic of the listening comfort model according to an embodiment of the invention.

Reference is now made to FIG. 3 that is a block schematic of the listening comfort model used for determining the penalty gain vector $G_{pen}$ that is used in the speech optimization algorithm in order to improve listening comfort.

The input to the algorithm comprises an estimate of the noise 201 and an estimate of the combined speech and noise 202. In the first summation point 203 the value of the noise estimate 201 is subtracted from the value of the combined speech and noise estimate 202, hereby providing an estimate of the speech-only content. In the second summation point 204 the value of the estimate of the speech-only content is subtracted from a squelch constant 205 representing a squelch limit. Hereby it is ensured that no penalty gain (i.e. a negative gain) will be applied when the value of the estimate of the speech-only content exceeds the squelch limit. The output from the second summation point 204 is fed to a MAX block 206 where it is compared with the value of zero, hereby ensuring that the output from the MAX block 206 is positive. The output from the MAX block is subsequently fed to a first input of a first multiplication point 207.

The second input to the multiplication point 207 is provided by a second branch of the algorithm representing a modified noise estimate. In the third summation point 208 the value of the noise estimate 201 is subtracted from an offset constant 209 representing an offset limit. Hereby it is ensured that no penalty gain (i.e. a negative gain) will be applied when the value of the estimate of the noise is below the offset limit. The output from the third summation point 208 is fed to a second multiplication point 210 where the output from the third summation point 208 is conditioned through multiplication with a constant conditioning value 211. Subsequently the conditioned noise estimate is fed to a MIN block 212 where it is compared with the value of zero, hereby ensuring that the output from the MIN block 212 is negative. The output from the MIN block 212 is then fed to the second input of the first multiplication point 207.

As has been discussed above the two inputs to the first multiplication point 207 will always be of opposite sign, and the output from the first multiplication point 207 will therefore be equal to or less than zero. The output from the first multiplication point 207 is fed to a second MAX block 213 where it is compared with a minimum gain value 214 representing the largest negative value that the penalty gain value 215 is allowed to have. The output from the second MAX block 213 represents the penalty gain value 215 that is used in the speech optimization algorithm described above with reference to FIG. 2.

According to the algorithm described in FIG. 3 the penalty gain value will always be in the range between zero and the negative value given by the minimum gain value 214. It follows directly from the algorithm that the larger the noise estimate 201 the more negative the penalty gain value 215. Hereby a frequency band having a relatively high noise level will have its overall gain reduced, thereby improving the listening comfort for the user of the hearing aid having the speech optimization algorithm according to the invention. Further it follows directly from the algorithm that the smaller the difference between the value of the noise estimate 201 and the combined speech and noise estimate 202, the more negative the penalty gain value 215, whereby a frequency band that only contains a relatively small content of speech will have its overall gain reduced, thereby further improving the listening comfort for the user.

According to the embodiment of FIG. 3 all values are given in dB. The value of the noise estimate 201 is determined as the 10% percentile and the value of the combined speech and noise estimate 202 is determined as the 90% percentile. The value of the squelch constant 205 and the off constant 209 are both set to 40 dB. The minimum gain value 214 is set to −18 dB.

In variations of the embodiment of FIG. 3 the noise and speech estimates may be determined by any suitable estimation means other than percentiles and other values for the percentiles may be used. Obviously the constants used to determine the penalty gain may also be varied, e.g. to suit specific user preferences.

We claim:

1. A hearing aid with an input transducer, a processor, and an acoustic output transducer, said processor comprising a band-split filter, an estimator adapted for estimating speech and noise, a first gain vector component for providing a first gain vector comprising a first set of gain values to be applied in a corresponding set of frequency bands in order to alleviate a hearing loss of a hearing aid user, and a speech enhancement unit adapted for improving a speech intelligibility measure, wherein said speech enhancement unit comprises a second gain vector component for providing a second gain vector comprising an initial set of second gain values to be applied in a corresponding set of frequency bands, a calculator component for calculating a gradient of a speech intelligibility measure as a function of said second gain vector using a closed form expression and for iteratively updating the set of second gain values to improve speech intelligibility, a gain vector modifier for modifying said first gain vector by application of the set of second gain values; and an input signal processor for processing the input signal in accordance with said modified first gain vector, hereby providing an output signal adapted for driving said output transducer, wherein said speech enhancement unit comprises an optimizer configured for optimizing the speech intelligibility measure based on the sign of a modified value of a partial derivative of said calculated gradient, wherein said modified value is found by adding a parameter value to said partial derivative of said calculated gradient, wherein said parameter value is adapted to improve listening comfort, and wherein said parameter value is derived from an estimate of noise and speech in the sound environment.

2. The hearing aid according to claim 1, wherein said modified first gain vector represents the frequency dependent gains that are applied in the hearing aid in a multitude of frequency bands.

3. The hearing aid according to claim 1, wherein said modified first gain vector is derived from the frequency dependent gains that are applied in the hearing aid in a multitude of frequency bands.

4. The hearing aid according to claim 1, wherein said speech intelligibility measure is a speech intelligibility index.

5. A method of processing a signal in a hearing aid, the method comprising the steps of:

receiving an input signal from a microphone, splitting the input signal into a number of frequency bands, selecting a first gain vector comprising a set of first gain values to be applied in a corresponding set of frequency bands in order to alleviate a hearing loss of a hearing aid user, selecting a second gain vector comprising an initial set of second gain values to be applied in a corresponding set of frequency bands;

determining a set of gradient elements of a speech intelligibility measure as a function of the second gain vector, using a closed form expression of the gradient as a function of the second gain vector, said closed form expression of the gradient of the second gain vector being derived using an energy summation approximation;

updating the set of second gain values by application of the set of gradient elements, in order to determine a new set of second gain values optimized for speech intelligibility;

determining whether to conduct further iterations, and in the affirmative reverting to the step of determining a set of gradient elements, and in the negative proceeding to the next step;

modifying the first gain vector by application of the set of second gain values; and processing the input signal in accordance with the modified first gain vector, hereby providing an output signal adapted for driving an output transducer.

6. The method according to claim 5, wherein the set of second gain values is adapted to replace the set of first gain values.

7. The method according to claim 5, wherein the set of second gain values are adapted to be added to the first set of gain values.

8. The method according to claim 5, wherein the speech intelligibility measure is derived from the speech intelligibility index, and the energy summation approximation is used for calculating the equivalent masking spectrum level.

9. A method of processing a signal in a hearing aid, the method comprising the steps of:

receiving an input signal from a microphone;

splitting the input signal into a number of frequency bands;

selecting a first gain vector comprising a set of first gain values to be applied in a corresponding set of frequency bands in order to alleviate a hearing loss of a hearing aid user;

selecting a second gain vector comprising an initial set of second gain values to be applied in a corresponding set of frequency bands;

determining a set of gradient elements of a speech intelligibility measure as a function of the second gain vector, using a closed form expression of the gradient as a function of the second gain vector, deriving the closed form expression of the gradient as a function of the second gain vector using a power function approximation and subsequent curve-fitting;

updating the set of second gain values by application of the set of gradient elements, in order to determine a new set of second gain values optimized for speech intelligibility;

determining whether to conduct further iterations, and in the affirmative reverting to the step of determining a set of gradient elements, and in the negative proceeding to the next step;

modifying the first gain vector by application of the set of second gain values; and processing the input signal in accordance with the modified first gain vector, hereby providing an output signal adapted for driving an output transducer.

10. The method according to claim 9 wherein the speech intelligibility measure is derived from the speech intelligibility index, and the power function approximation and subsequent curve-fitting is used for calculating the band audibility.

* * * * *